US011777188B2

(12) United States Patent
Deleniv et al.

(10) Patent No.: US 11,777,188 B2
(45) Date of Patent: Oct. 3, 2023

(54) COOLING IN A WAVEGUIDE ARRANGEMENT

(71) Applicant: Telefonaktiebolaget LM Ericsson (publ), Stockholm (SE)

(72) Inventors: Anatoli Deleniv, Mölndal (SE); Per Ingelhag, Alingsås (SE); Peter Melin, Lindome (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 167 days.

(21) Appl. No.: 17/421,764

(22) PCT Filed: Jan. 11, 2019

(86) PCT No.: PCT/EP2019/050640

§ 371 (c)(1),
(2) Date: Jul. 9, 2021

(87) PCT Pub. No.: WO2020/143919

PCT Pub. Date: Jul. 16, 2020

(65) Prior Publication Data

US 2022/0094032 A1 Mar. 24, 2022

(51) Int. Cl.
*H01Q 1/02* (2006.01)
*H01Q 13/02* (2006.01)
(Continued)

(52) U.S. Cl.
CPC ..... *H01Q 1/02* (2013.01); *H01Q 13/02* (2013.01); *H01Q 13/0233* (2013.01);
(Continued)

(58) Field of Classification Search
CPC .... H01Q 1/02; H01Q 21/0087; H01Q 21/064; H01Q 13/06; H01Q 13/00; H01Q 13/02;
(Continued)

(56) References Cited

U.S. PATENT DOCUMENTS 3,293,649 A 12/1966 Fox et al.
7,898,810 B2 * 3/2011 Mason ..... H05K 7/20163 361/717

(Continued)

FOREIGN PATENT DOCUMENTS

AU PP747098 12/1998
CA 2660553 A1 9/2009

(Continued)

OTHER PUBLICATIONS

International Search Report and Written Opinion of the International Searching Authority, PCT/EP2019/050640, dated Sep. 19, 2019, 10 pages.

(Continued)

*Primary Examiner* — Vibol Tan

(74) *Attorney, Agent, or Firm* — Sage Patent Group

(57) ABSTRACT

The present disclosure relates to a waveguide arrangement including a mounting printed circuit board, PCB, and at least a first waveguide layer. Each waveguide layer comprises at least a first waveguide conducting tube, each waveguide conducting tube having an electrically conducting inner wall. The PCB includes a signal interface for each waveguide conducting tube. The waveguide arrangement further includes at least a first coupling layer that is positioned between the PCB and the first waveguide conducting tube such that at least the first waveguide conducting tube of the first waveguide layer is connected to the corresponding signal interface via the first coupling layer.

15 Claims, 8 Drawing Sheets

(51) Int. Cl.
*H01Q 21/00* (2006.01)
*H01Q 21/06* (2006.01)
*H01Q 13/06* (2006.01)

(52) U.S. Cl.
CPC ..... *H01Q 13/06* (2013.01); *H01Q 21/0087* (2013.01); *H01Q 21/064* (2013.01)

(58) Field of Classification Search
CPC ... H01Q 13/0233; H01Q 13/0283; H01P 1/30
See application file for complete search history.

(56) References Cited

U.S. PATENT DOCUMENTS

| | | | | |
|---|---|---|---|---|
| 9,865,935 | B2 * | 1/2018 | Miraftab | H01Q 21/005 |
| 10,082,570 | B1 * | 9/2018 | Izadian | G01S 13/90 |
| 10,186,787 | B1 * | 1/2019 | Wang | H01Q 21/005 |
| 11,217,901 | B1 * | 1/2022 | Wink | H01Q 13/0283 |
| 2007/0139287 | A1 | 6/2007 | Inomata et al. | |
| 2010/0066631 | A1 * | 3/2010 | Puzella | H01Q 21/0025 29/601 |
| 2011/0102296 | A1 | 5/2011 | Scott | |
| 2012/0218160 | A1 | 8/2012 | Montgomery et al. | |
| 2013/0141300 | A1 | 6/2013 | Runyon et al. | |

FOREIGN PATENT DOCUMENTS

| | | | | |
|---|---|---|---|---|
| CN | 105261841 | A | 1/2016 | |
| JP | 2007192804 | A | 8/2007 | |
| WO | WO-2010111038 | A1 * | 9/2010 | H01Q 1/02 |
| WO | WO 2018/010792 | A1 | 1/2018 | |
| WO | WO 2019/206407 | A1 | 10/2019 | |
| WO | WO 2019/214816 | A1 | 11/2019 | |

OTHER PUBLICATIONS

Chinese Office Action, Chinese Application 201980088482.1, dated Apr. 26, 2023, 9 pages.
English Translation of Chinese Office Action, Chinese Application 201980088482.1, dated Apr. 26, 2023, 10 pages.

* cited by examiner

COOLING IN A WAVEGUIDE ARRANGEMENT

CROSS REFERENCE TO RELATED APPLICATIONS

This application is a 35 U.S.C. § 371 national stage application of PCT International Application No. PCT/EP2019/050640 filed on Jan. 11, 2019, the disclosure and content of which is incorporated by reference herein in its entirety.

TECHNICAL FIELD

The present disclosure relates to a waveguide arrangement comprising a mounting printed circuit board (PCB) and at least a first waveguide layer. Each waveguide layer in turn comprises at least a first air-filled waveguide conducting tube, where each air-filled waveguide conducting tube has an electrically conducting inner wall.

BACKGROUND

Antenna elements are devices configured to emit and/or to receive electromagnetic signals such as radio frequency (RF) signals used for wireless communication. Phased antenna arrays are antennas comprising a plurality of antenna elements, by which an antenna radiation pattern can be controlled by changing relative phases and amplitudes of signals fed to the different antenna elements.

Practical implementation of signal filtering functions for such antenna elements is a challenging task. High Q-factor, multiple resonators and high precision are required to achieve filters with low loss and strong suppression of frequencies near the operation band where interference or leakage of radio frequency (RF) power may occur. Moreover, effective cooling of power amplifiers on a PCB (printed circuit board) is required, Existing solutions are bulky and expensive and even create cooling problems by blocking direct access to a surface of cooling entity e.g. cooling fin. This leaves only an opposite side of the PCB to be used for cooling. This may not be easily attached due to other parts of the system.

Therefore, a reliable, compact and lightweight solution is required, that also is inexpensive to produce.

SUMMARY

An object of the present disclosure is to provide an improved filter arrangement for possible use with antenna elements, providing effective and reliable cooling of produced heat.

This object is achieved by means of waveguide arrangement comprising a mounting printed circuit board (PCB) and at least a first waveguide layer. Each waveguide layer in turn comprises at least a first waveguide conducting tube, where each waveguide conducting tube has an electrically conducting inner wall. The PCB comprises a signal interface for each waveguide conducting tube. The waveguide arrangement further comprises at least a first coupling layer that is positioned between the PCB and the first waveguide conducting tube such that at least the first waveguide conducting tube of the first waveguide layer is connected to the corresponding signal interface via the first coupling layer. Each coupling layer comprises air passages that enable air to pass through the coupling layer.

In this way, ventilation is integrated into the waveguide arrangement in an efficient manner According to some aspects, the waveguide arrangement comprises a bottom waveguide layer that is positioned on the PCB and the first coupling layer connects the bottom waveguide layer to the first waveguide layer.

According to some aspects, alternatively, the first coupling layer is positioned on the PCB.

In this way, either a waveguide layer or a coupling layer can be positioned on the PCB.

According to some aspects, the waveguide arrangement comprises at least one further waveguide layer and at least one further coupling layer. Each further coupling layer is positioned between two adjacent waveguide layers such that a stacked structure is formed where the waveguide layers and the coupling layers together define at least one resulting waveguide conducting tube.

In this way, a ventilated waveguide arrangement that can be adapted for any size and possible filter poles is provided.

According to some aspects, the waveguide layer that is furthest from the PCB comprises an antenna element for each resulting waveguide conducting tube. Each antenna element comprises an antenna aperture that is arranged to interface with a transmission medium for transmission and reception of RF (radio frequency) waveforms.

In this way, an antenna functionality is added.

According to some aspects, each resulting waveguide conducting tube comprises filtering elements such that a radio frequency signal passing via a resulting waveguide conducting tube is arranged to be electromagnetically filtered.

In this way, a filtering functionality is added.

According to some aspects, each coupling layer comprises a frame and rows of pins protruding in opposite directions from the frame. A row of pins is adapted to press-fit into a corresponding groove comprised in an adjacent waveguide layer.

In this way, efficient and easily mountable coupling layers are provided.

According to some aspects, each row of pins presents gaps between adjacent pins, where each gap is adapted to admit an air stream to pass and at the same time constitute a virtual conductive wall.

This enables air passage for ventilation as well as electric isolation for RF waveforms.

According to some aspects, the waveguide arrangement comprises at least one fan arrangement that is adapted to convey a cooling air stream via the air passages.

In this way, forced ventilation is enabled.

There are also disclosed herein a coupling layer and a method which are associated with the above-mentioned advantages.

BRIEF DESCRIPTION OF THE DRAWINGS

Further objects, features, and advantages of the present disclosure will appear from the following detailed description, wherein some aspects of the disclosure will be described in more detail with reference to the accompanying drawings, in which.

DETAILED DESCRIPTION

The inventive concept will now be described more fully hereinafter with reference to the accompanying drawings, in which certain embodiments of the inventive concept are shown. This inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1:
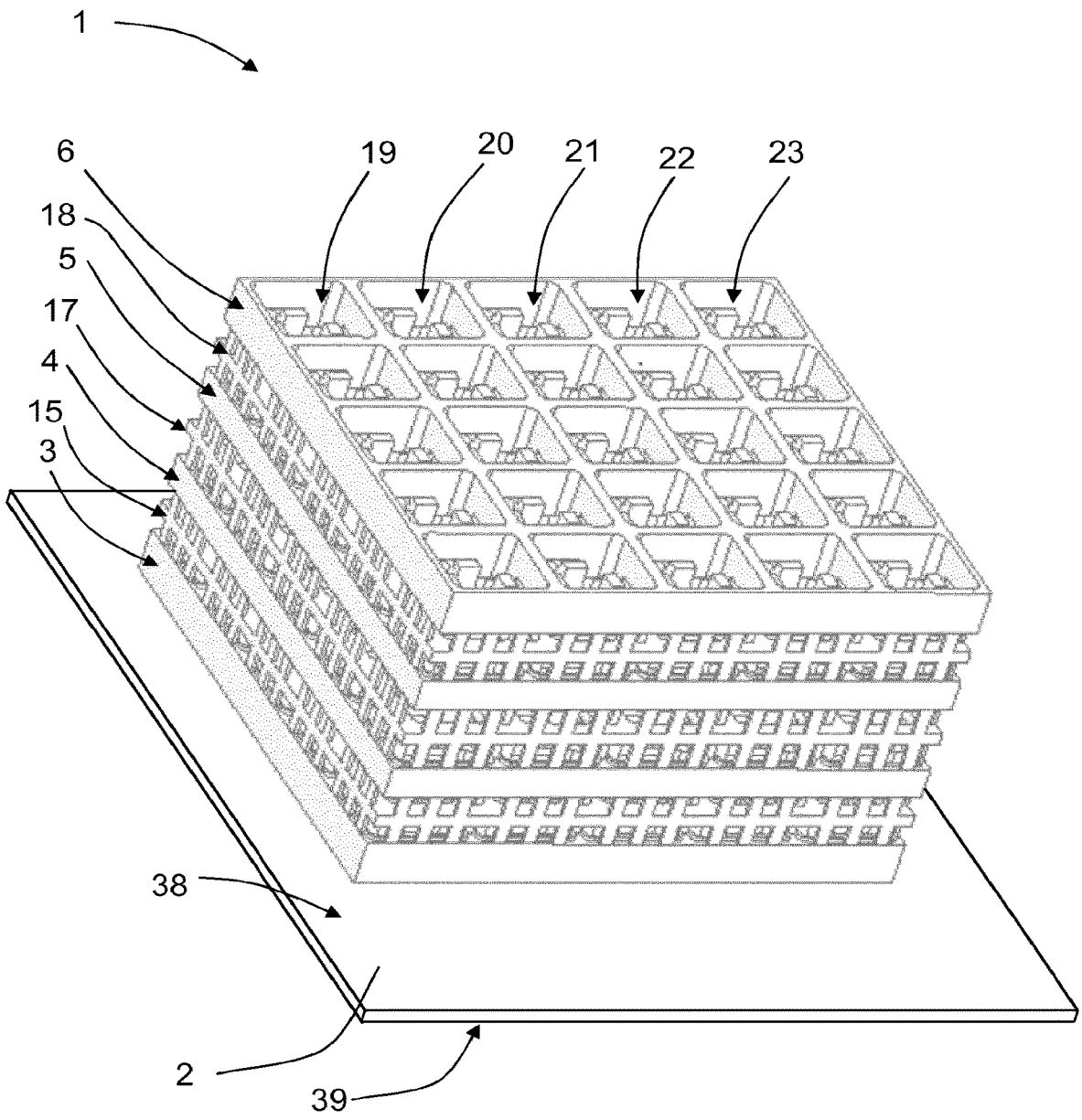
FIG. 1 shows a schematical perspective view of a waveguide arrangement.
Figure 2A:
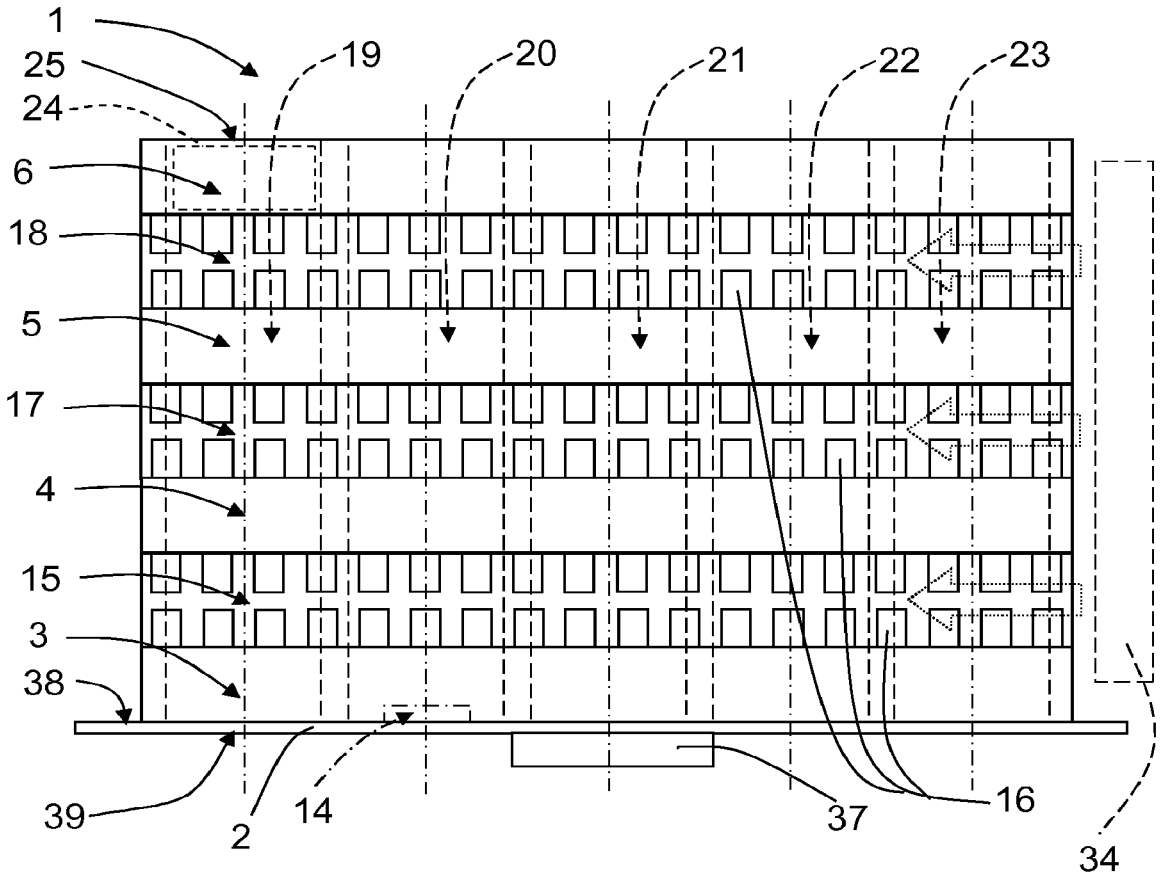
FIG. 2A shows a schematical side view of a waveguide arrangement according to a first example.
Figure 3:
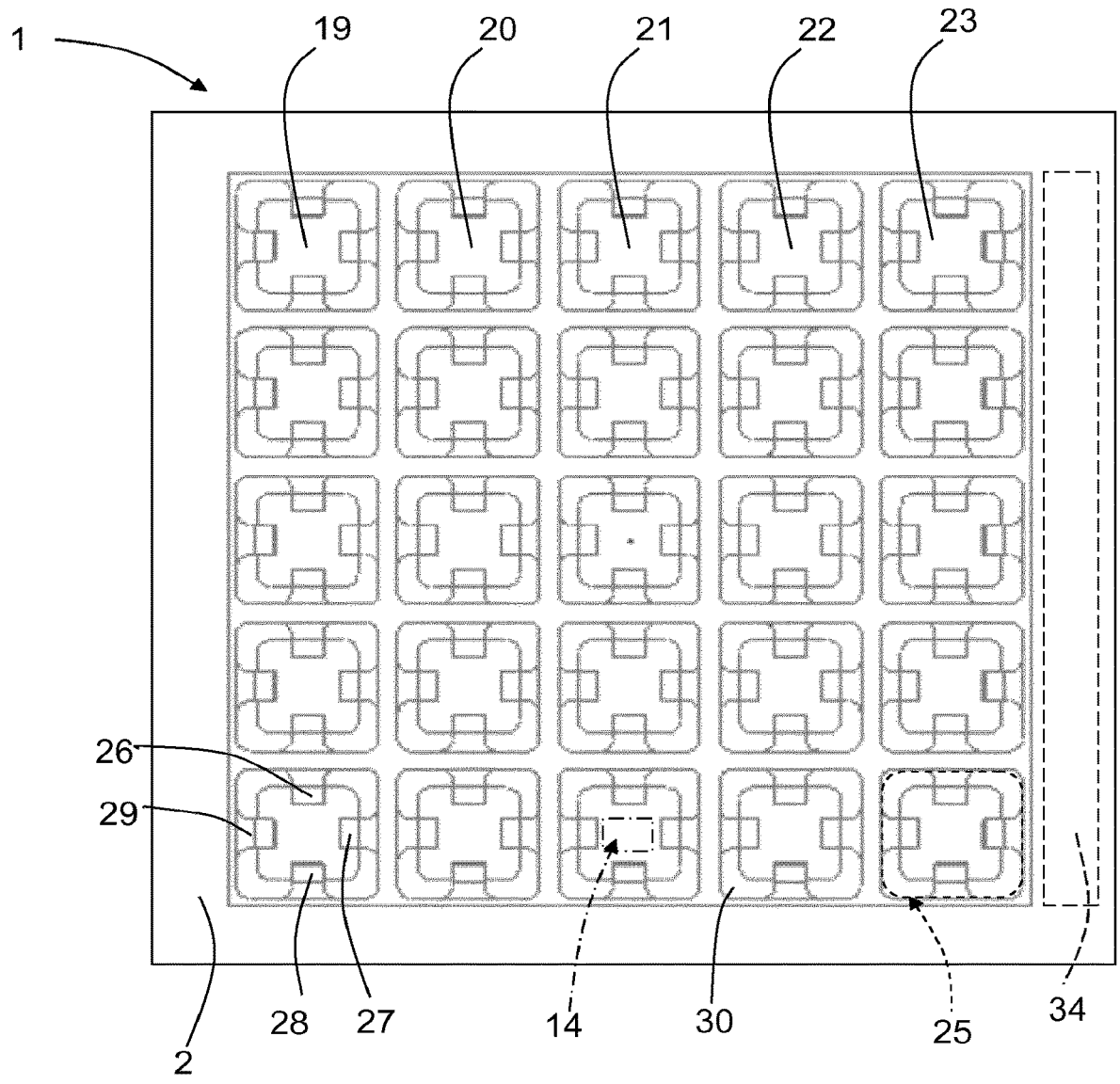
FIG. 3 shows a schematical top view of the waveguide arrangement.
Figure 4:
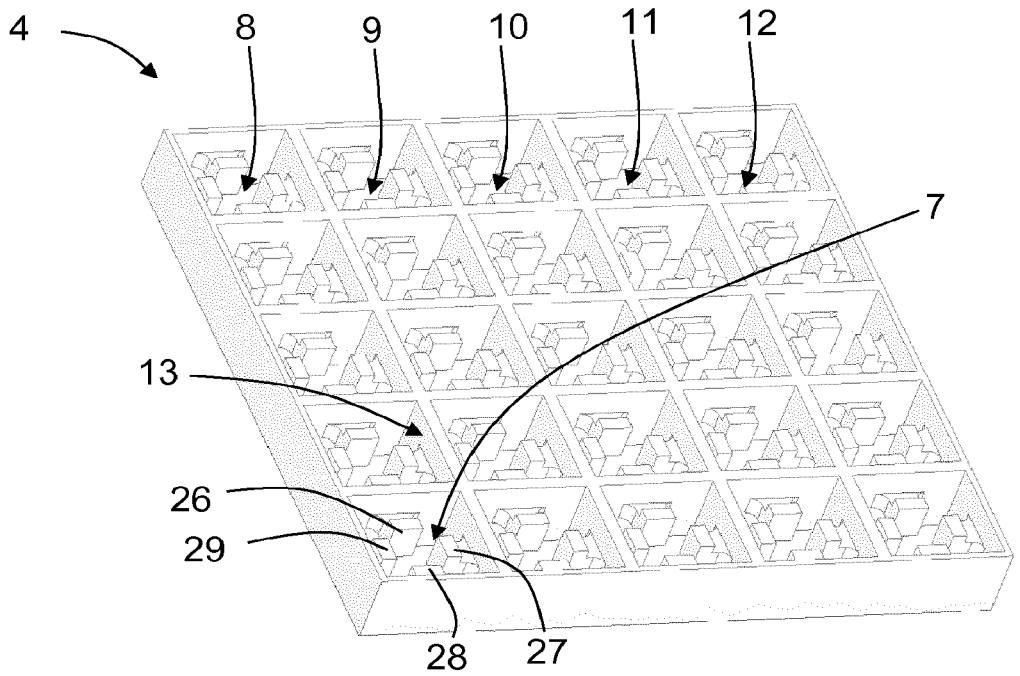
FIG. 4 shows a schematical perspective view of a waveguide layer.

FIG. 1 shows a perspective side view of a waveguide arrangement 1, FIG. 2A shows a corresponding side view according to a first example and FIG. 3 shows a corresponding top view. With reference to these Figures, the waveguide section 1 comprises a mounting printed circuit board 2 (PCB), a bottom waveguide layer 3 that is positioned on the PCB 2, a first waveguide layer 4, a second waveguide layer 5 and a third waveguide layer 6. With reference also to FIG. 4, showing a perspective view of a the first waveguide layer 4, each waveguide layer 3, 4, 5, 6 in turn comprises a plurality of air-filled waveguide conducting tubes 7, 8, 9, 10, 11, 12 (only a few indicated), each air-filled waveguide conducting tube 7, 8, 9, 10, 11, 12 having an electrically conducting inner wall 13

According to the present disclosure, the waveguide arrangement 1 further comprises a plurality of coupling layers 15, 17, 18, where each coupling layer 15, 17, 18 is positioned between two adjacent waveguide layers 3, 4, 5, 6 such that a stacked structure is formed where the waveguide layers 3, 4, 5, 6 and the coupling layers 15, 17, 18 together define a plurality of resulting air-filled waveguide conducting tubes 19, 20, 21, 22, 23. The coupling layers 15, 17, 18 comprises air passages 16 that enable air to pass through the coupling layers 15, 17, 18.

Here, there is a first coupling layer 15 that is positioned between the bottom waveguide layer 3 and the first waveguide layer 4, a second coupling layer 17 that is positioned between the first waveguide layer 4 and the second waveguide layer 5, and a third coupling layer 18 that is positioned between the second waveguide layer 5 and the third waveguide layer 6.

The resulting air-filled waveguide conducting tubes 19, 20, 21, 22, 23 are formed by corresponding air-filled waveguide conducting tubes 7, 8, 9, 10, 11, 12 of the waveguide layers 3, 4, 5, 6 and corresponding passages formed in the coupling layers 15, 17, 18. How these passages are formed will be described more in detail later.

The PCB 2 comprises a signal interface 14 for each resulting air-filled waveguide conducting tube 19, 20, 21, 22, 23 (only one signal interface 14 is schematically indicated in FIG. 2A). Each signal interface 14 is adapted for signal transfer to and from a radio device 37 such as for example a transceiver or an amplifier arrangement. The radio device 37 is according to some aspects a heat source, and the heat emitted partly spreads within the waveguide arrangement 1 is ventilated by means of the air passages 16 that enable air to pass through the coupling layers 15, 17, 18.

According to some aspects, in order to enhance the ventilation via the air passages 16, the waveguide arrangement 1 comprises at least one fan arrangement 34 (indicated with dashed lines in FIG. 2A) that is adapted to convey a cooling air stream 35 via the air passages 16, enabling a forced ventilation. There can be two or more fan arrangements that for example pair-wise are directed opposite each other. According to some aspects, the cooling air stream 35 or cooling air streams are directed perpendicular to a longitudinal extension E of the resulting air-filled waveguide conducting tubes 19, 20, 21, 22, 23. The fan or fan arrangements 34 do not need to be in direct contact to the waveguide arrangement 1.

Figure 2B:
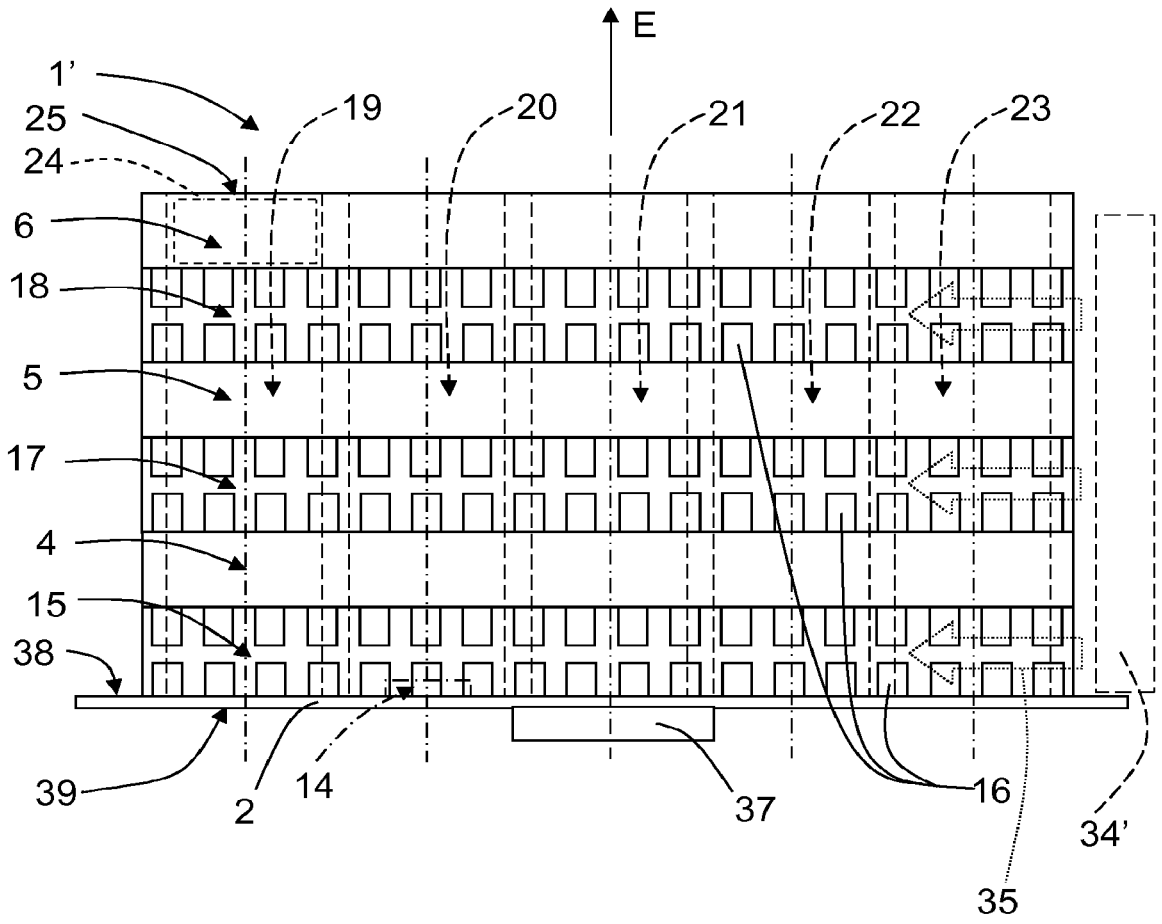
FIG. 2B shows a schematical side view of a waveguide arrangement according to a second example.

According to some aspects, with reference to FIG. 2B that corresponds to the view of FIG. 2A, there is a waveguide arrangement 1' where the first coupling layer 15 is positioned on the PCB 2, and there is no bottom waveguide layer. The basic structure of this waveguide arrangement 1' is otherwise the same as the waveguide arrangement 1 discussed previously; this illustrates that either a waveguide layer or a coupling layer can be positioned on the PCB 2.

Irrespective of if a waveguide layer or a coupling layer is positioned on the PCB 2, it should according to some aspects be soldered or in other way attached to a top side 38 of the PCB 2 and vias (not shown) connecting to the radio device 37 or other heat generating devices on a backside 39 of the PCB.

According to some aspects, as illustrated for one resulting air-filled waveguide conducting tube 19, the waveguide layer that is furthest from the PCB 2, here the third waveguide layer 6, comprises an antenna element 24 for each resulting air-filled waveguide conducting tube 19, 20, 21, 22, 23. Each antenna element 24 comprises an antenna aperture 25 that is arranged to interface with a transmission medium for transmission and reception of RF (radio frequency) waveforms.

Figure 5:
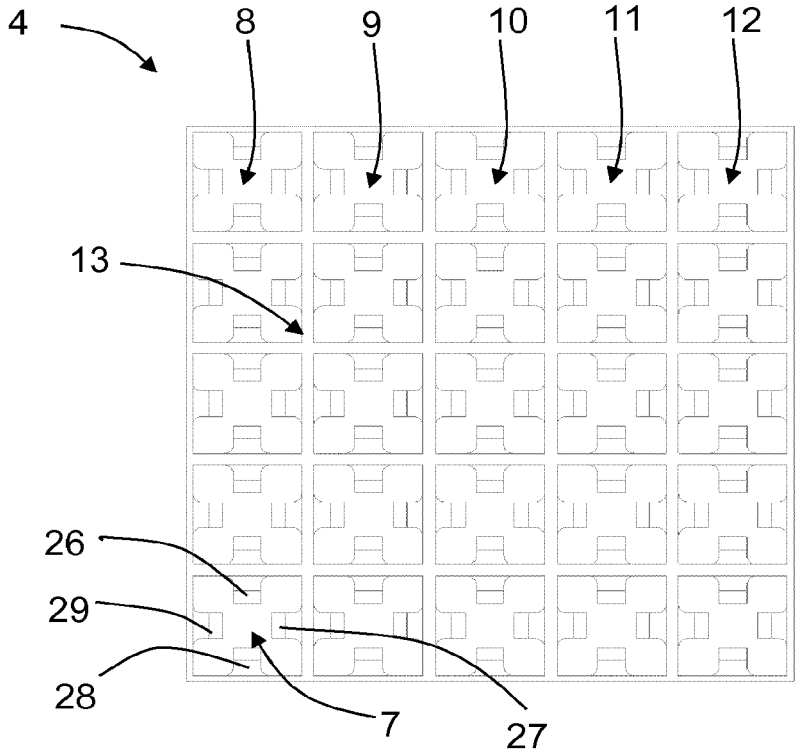
FIG. 5 shows a schematical top view of a waveguide layer.
Figure 7:
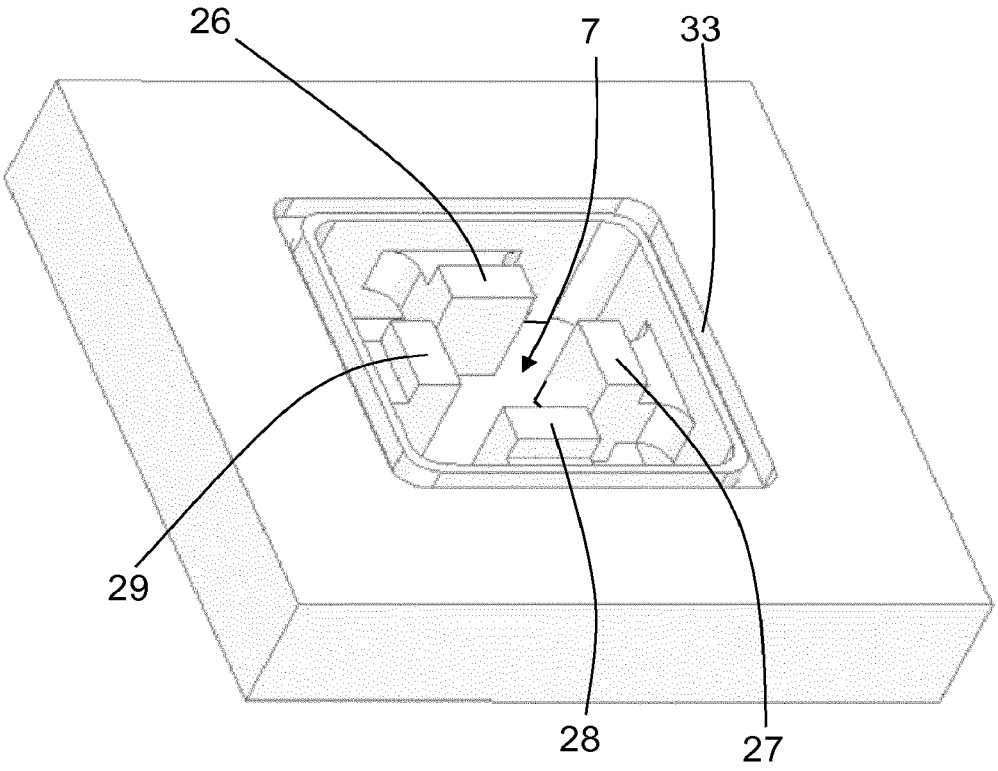
FIG. 7 shows a schematical perspective view of an air-filled waveguide conducting tube.

According to some aspects, with reference also to FIG. 4 and FIG. 5 that show a perspective view and a top view of the first waveguide layer 4, each waveguide conducting tube 8, 9, 10, 11, 12 and thus each resulting air-filled waveguide conducting tube 19, 20, 21, 22, 23 comprises filtering elements 26, 27, 28, 29 such that a radio frequency signal passing via a resulting air-filled waveguide conducting tube 19, 20, 21, 22, 23 is arranged to be electromagnetically filtered. In this manner, each resulting air-filled waveguide conducting tube 19, 20, 21, 22, 23 constitutes a quad-ridge waveguide. The filtering elements 26, 27, 28, 29 are also shown in FIG. 7 that shows a detailed perspective view of one waveguide conducting tube 7. The filtering elements can be of any suitable number and shape, these being previously well-known.

According to some aspects, each waveguide conducting tube 8, 9, 10, 11, 12 can instead, or in combination with filtering elements, have a dielectric filling. In this case, the waveguide conducting tube are not air-filled. In the following, however, the waveguide conducting tube will be referred to as air-filled according to the example shown in FIG. 7. Generally, however, the waveguide conducting tube can either be filled by air or a dielectric material. Both variants are suitable for filter-antennas with dual polarization, which, however, is not essential in the context of the present disclosure. Generally, there need not be any filtering or radiating properties of a waveguide arrangement 1, 1' according to the present disclosure, but there should be formed at least one resulting waveguide conducting tube.

Figure 6:
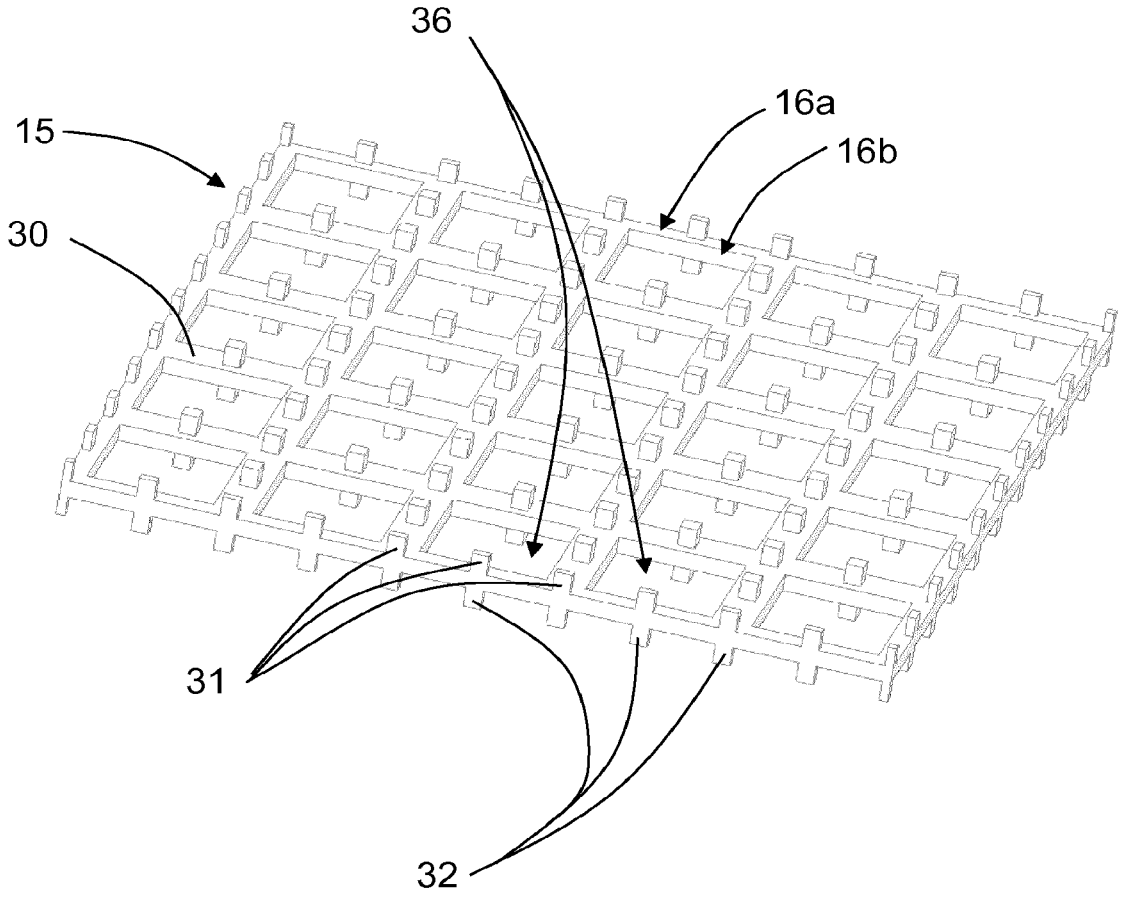
FIG. 6 shows a schematical perspective view of a coupling layer.
Figure 8:
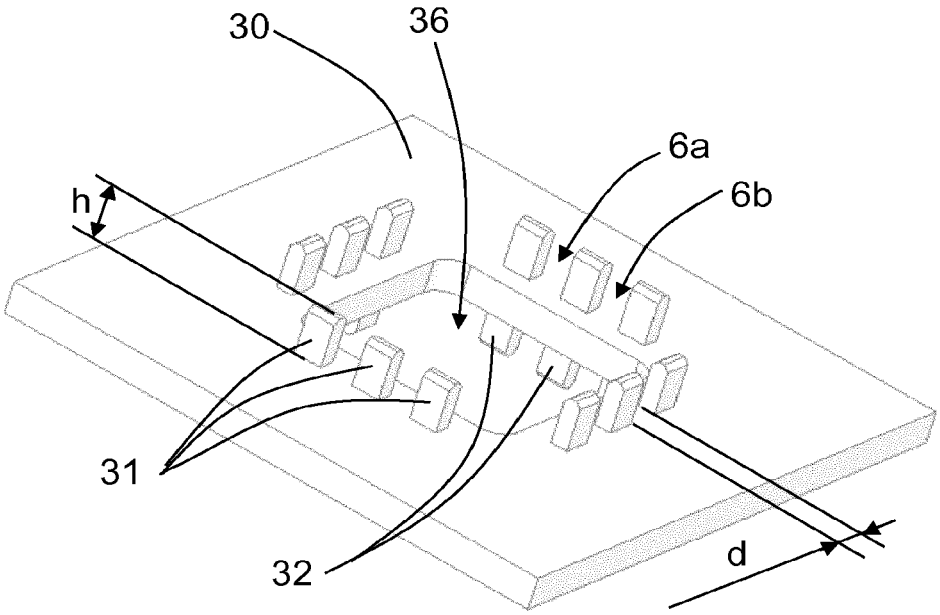
FIG. 8 shows a schematical perspective view of a part of the coupling layer that corresponds to the air-filled waveguide conducting tube.

With reference to FIG. 6, showing a perspective view of the first coupling layer 15, and FIG. 8, showing a perspective view of a coupling aperture 36, each coupling layer comprises a frame 30 and rows of pins 31, 32 protruding in opposite directions from the frame 30. A row of pins 31, 32 circumvent a corresponding coupling aperture 36, each row of pins 31, 32 and corresponding coupling aperture 36 being comprised in the passages formed in the coupling layers 15, 17, 18. Each row of pins 31, 32 presents gaps 16*a*, 16*b* between adjacent pins, where each gap 16*a*, 16*b* is adapted to admit the air stream 35 to pass and at the same time constitute a virtual conductive wall.

Only a few pins, coupling apertures and gaps indicated for reason of clarity.

With reference also to FIG. 7, there is a groove 33 circumventing each air-filled waveguide conducting tube 7 where a corresponding row of pins 31, 32 is adapted to press-fit into such a corresponding groove 33 comprised in an adjacent waveguide layer. In case a waveguide layer is to be positioned between two coupling layers, there are two opposing grooves that are adapted to receive pins from both sides.

The waveguide arrangement 1, 1' according to the present disclosure contains several interconnected resonators in waveguide layers and coupling layers. According to some aspects, the number of waveguide layers is defined by filtering function requirements such as rejection, bandwidth, etc. A typical phased array is a periodic structure with a so-called unit cell. The size of the latter does not exceed half the wavelength at the highest operating frequency.

It is a design of a semi-air-transparent coupling layer 15, 17, 18 that enables a possibility of forced convection. The thickness of the frame 30 should allow sufficient rigidity of the structure, so it can be used for press fitting pins 31, 32 into grooves 33. A height h of the pins 31, 32, that according to some aspects function as shorting pins, and a spacing d between them are chosen as a compromise between two contradictory requirements:

1) Good "transparency" for air, for example during forced convection, demands a relatively large spacing d between adjacent pins 31, 32.

2) Good isolation between two adjacent waveguide conducting tubes (in case of more than one waveguide conducting tube) requires use of a relatively small spacing d between adjacent pins 31, 32.

Each coupling aperture 36 controls the level of coupling between adjacent waveguide tubes, and its size constitutes a parameter that allows the height h of the pins 31, 32 to be chosen such that sufficient cooling properties are obtained.

By means of the present disclosure, a compact building practice is possible.

Figure 9:
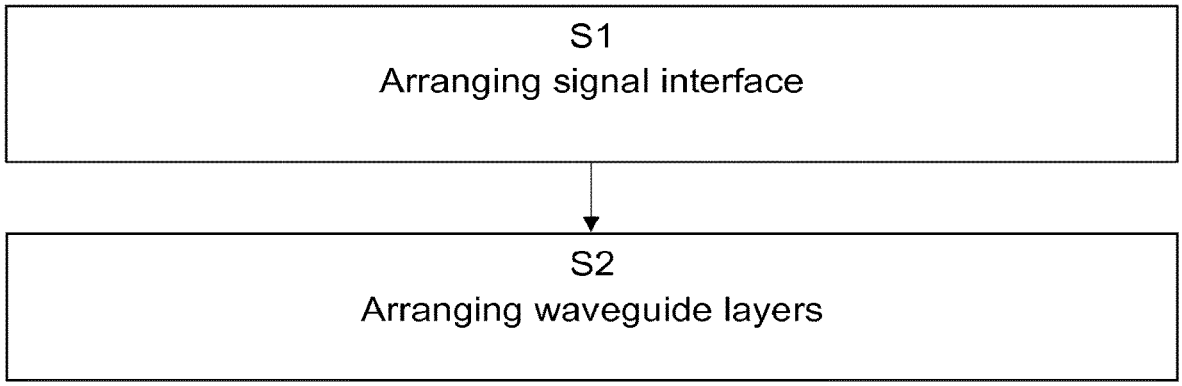
FIG. 9 shows a flowchart schematically illustrating methods according to embodiments.

The present disclosure also relates to a method, as shown in FIG. 9. There is thus a method of configuring a waveguide arrangement 1, 1' comprising at least a first waveguide layer 4. Each waveguide layer 3, 4, 5, 6 in turn comprises at least a first waveguide conducting tube 7, 8, 9, 10, 11, 12, where each waveguide conducting tube 7, 8, 9, 10, 11, 12 has an electrically conducting inner wall 13. The method comprises arranging S1 one signal interface 14 for each waveguide conducting tube 7, 8, 9, 10, 11, 12 on a mounting printed circuit board 2 (PCB). The method further comprises arranging S2 one or more waveguide layers 3, 4, 5, 6 in an interleaved manner with at least a first coupling layer 15, 17, 18 on the PCB 2 so as to form the waveguide arrangement 1, 1', such that each waveguide conducting tube 7, 8, 9, 10, 11, 12 of the first waveguide layer 4 is connected to the corresponding signal interface 14 via the first coupling layer 15. Each coupling layer 15 comprises air passages 16, 16*a*, 16*b* that enable air to pass through the coupling layer 15.

According to some aspects, the method comprises positioning a bottom waveguide layer 3 on the PCB 2, the first coupling layer 15 connecting the bottom waveguide layer 3 to the first waveguide layer 4.

According to some aspects, the method comprises positioning the first coupling layer 15 on the PCB 2.

According to some aspects, the method comprises using at least one further waveguide layer 5, 6 and at least one further coupling layer 17, 18, and where the method further comprises positioning each further coupling layer 17, 18 between two adjacent waveguide layers 4, 5, 6. In this way, a stacked structure is formed, the waveguide layers 3, 4, 5, 6 and the coupling layers 15, 17, 18 together defining at least one resulting waveguide conducting tube 19, 20, 21, 22, 23.

According to some aspects, the method comprises arranging an antenna element 24 for each resulting waveguide conducting tube 19, 20, 21, 22, 23 at the waveguide layer 6 that is furthest from the PCB 2. Each antenna element 24 has an antenna aperture 25 that is used for interfacing with a transmission medium for transmission and reception of RF, radio frequency, waveforms.

According to some aspects, the method comprises arranging filtering elements 26, 27, 28, 29 in each resulting waveguide conducting tube 19, 20, 21, 22, 23, such that a radio frequency signal passing via a resulting waveguide conducting tube 19, 20, 21, 22, 23 is arranged to be electromagnetically filtered.

The present disclosure also relates to a coupling layer 15, 17, 18 that is adapted to be mounted adjacent at least one waveguide layer 4 that comprises at least one waveguide conducting tube 7, 8, 9, 10, 11, 12 with an electrically conducting inner wall 13. The coupling layer 15, 17, 18 comprises air passages 16, 16*a*, 16*b* that enable air to pass through the coupling layer 15, 17, 18 and is adapted to be positioned between one waveguide layer 4 and a mounting printed circuit board 2 (PCB).

According to some aspects, the coupling layer 15, 17, 18 comprises a frame 30 and rows of pins 31, 32 protruding in opposite directions from the frame 30, where a row of pins 31, 32 is adapted to press-fit into a corresponding groove 33 comprised in an adjacent waveguide layer.

According to some aspects, each row of pins 31, 32 presents gaps 16; 16*a*, 16*b* between adjacent pins, where each gap 16; 16*a*, 16*b* is adapted to admit an air stream 35 to pass and at the same time constitute a virtual conductive wall.

The present disclosure is not limited to the above, but may vary freely within the scope of the appended claims. For example, instead of the pins engaging a groove; the pins may instead engage a waveguide gasket, electrically conducting glue or soldering is also conceivable. The pins may also have any convenient shape, and may be constituted by a grid.

There may be any number of waveguide layers and coupling layers, but at least one of each. Each waveguide layer 3, 4, 5, 6 comprises at least one waveguide conducting tube 7, 8, 9, 10, 11, 12.

Generally, the present disclosure relates to waveguide arrangement 1, 1' comprising a mounting printed circuit board 2, PCB, and at least a first waveguide layer 4, where each waveguide layer 3, 4, 5, 6 in turn comprises at least a first waveguide conducting tube 7, 8, 9, 10, 11, 12. Each waveguide conducting tube 7, 8, 9, 10, 11, 12 has an electrically conducting inner wall 13, where the PCB 2 comprises a signal interface 14 for each waveguide conducting tube 7, 8, 9, 10, 11, 12. The waveguide arrangement 1, 1' further comprises at least a first coupling layer 15 that is positioned between the PCB and the first waveguide conducting tube such that at least the first waveguide conducting tube 7, 8, 9, 10, 11, 12 of the first waveguide layer 4 is connected to the corresponding signal interface 14 via the first coupling layer 15. Each coupling layer 15 comprises air passages 16, 16*a*, 16*b* that enable air to pass through the coupling layer 15.

According to some aspects, the waveguide arrangement 1 comprises a bottom waveguide layer 3 that is positioned on the PCB 2 and where the first coupling layer 15 connects the bottom waveguide layer 3 to the first waveguide layer 4.

According to some aspects, the first coupling layer 15 is positioned on the PCB 2.

According to some aspects, the waveguide arrangement 1, 1' comprises at least one further waveguide layer 5, 6 and at least one further coupling layer 17, 18, where each further coupling layer 17, 18 is positioned between two adjacent waveguide layers 4, 5, 6 such that a stacked structure is formed where the waveguide layers 3, 4, 5, 6 and the coupling layers 15, 17, 18 together define at least one resulting waveguide conducting tube 19, 20, 21, 22, 23.

According to some aspects, the waveguide layer 6 that is furthest from the PCB comprises an antenna element 24 for each resulting waveguide conducting tube 19, 20, 21, 22, 23. Each antenna element 24 comprises an antenna aperture 25 that is arranged to interface with a transmission medium for transmission and reception of RF, radio frequency, waveforms.

According to some aspects, each resulting waveguide conducting tube 19, 20, 21, 22, 23 comprises filtering elements 26, 27, 28, 29 such that a radio frequency signal passing via a resulting waveguide conducting tube 19, 20, 21, 22, 23 is arranged to be electromagnetically filtered.

According to some aspects, each coupling layer 15, 17, 18 comprises a frame 30 and rows of pins 31, 32 protruding in opposite directions from the frame 30, where a row of pins 31, 32 is adapted to press-fit into a corresponding groove 33 comprised in an adjacent waveguide layer.

According to some aspects, each row of pins 31, 32 presents gaps 16; 16*a*, 16*b* between adjacent pins, where each gap 16; 16*a*, 16*b* is adapted to admit an air stream 35 to pass and at the same time constitute a virtual conductive wall.

According to some aspects, the waveguide arrangement 1, 1' comprises at least one fan arrangement 34 that is adapted to convey a cooling air stream 35 via the air passages 16.

The invention claimed is:

1. A waveguide arrangement comprising a mounting printed circuit board, PCB, and at least a first waveguide layer, where each waveguide layer in turn comprises at least a first waveguide conducting tube, each waveguide conducting tube having an electrically conducting inner wall, where the PCB comprises a signal interface for each waveguide conducting tube, wherein the waveguide arrangement further comprises at least a first coupling layer that is positioned between the PCB and the first waveguide conducting tube such that at least the first waveguide conducting tube of the first waveguide layer is connected to the corresponding signal interface via the first coupling layer, where each coupling layer comprises air passages that enable air to pass through the coupling layer, wherein the waveguide arrangement comprises at least one further waveguide layer and at least one further coupling layer, where each further coupling layer is positioned between two adjacent waveguide layers such that a stacked structure is formed where the waveguide layers and the coupling layers together define at least one resulting waveguide conducting tube.

2. The waveguide arrangement according to claim 1, wherein the waveguide arrangement comprises a bottom waveguide layer that is positioned on the PCB and where the first coupling layer connects the bottom waveguide layer to the first waveguide layer.

3. The waveguide arrangement according to claim 1, wherein the first coupling layer is positioned on the PCB.

4. The waveguide arrangement according to claim 1, wherein the waveguide layer that is furthest from the PCB comprises an antenna element for each resulting waveguide conducting tube, each antenna element comprising an antenna aperture that is arranged to interface with a transmission medium for transmission and reception of RF, radio frequency, waveforms.

5. The waveguide arrangement according to claim 1, wherein each resulting waveguide conducting tube comprises filtering elements such that a radio frequency signal passing via a resulting waveguide conducting tube is arranged to be electromagnetically filtered.

6. The waveguide arrangement according to claim 1, wherein each coupling layer comprises a frame and rows of pins protruding in opposite directions from the frame, where a row of pins is adapted to press-fit into a corresponding groove comprised in an adjacent waveguide layer.

7. The waveguide arrangement according to claim 6, wherein each row of pins presents gaps between adjacent pins, where each gap is adapted to admit an air stream to pass and at the same time constitute a virtual conductive wall.

8. The waveguide arrangement according to claim 1, wherein the waveguide arrangement comprises at least one fan arrangement that is adapted to convey a cooling air stream via the air passages.

9. A coupling layer that is adapted to be mounted adjacent at least one waveguide layer, the coupling layer comprising at least one waveguide conducting tube with an electrically conducting inner wall, where the coupling layer comprises air passages that enable air to pass through the coupling layer and is adapted to be positioned between one waveguide layer and a mounting printed circuit board, PCB, wherein the coupling layer comprises a frame and rows of pins protruding in opposite directions from the frame, where a row of pins is adapted to press-fit into a corresponding groove comprised in an adjacent waveguide layer.

10. The coupling layer according to claim 9, wherein each row of pins presents gaps between adjacent pins, where each gap is adapted to admit an air stream to pass and at the same time constitute a virtual conductive wall.

11. A method of configuring a waveguide arrangement comprising at least a first waveguide layer, where each waveguide layer in turn comprises at least a first waveguide conducting tube, each waveguide conducting tube having an electrically conducting inner wall, where the method comprises:

arranging (S1) one signal interface for each waveguide conducting tube on a mounting printed circuit board, PCB; and arranging (S2) one or more waveguide layers in an interleaved manner with at least a first coupling layer on the PCB so as to form the waveguide arrangement, such that each waveguide conducting tube of the first waveguide layer is connected to the corresponding signal interface via the first coupling layer, where each coupling layer comprises air passages that enable air to pass through the coupling layer; and using at least one further waveguide layer and at least one further coupling layer to position each further coupling layer between two adjacent waveguide layers such that a stacked structure is formed, the waveguide layers and the coupling layers together defining at least one resulting waveguide conducting tube.

12. The method according to claim 11, wherein the method comprises positioning a bottom waveguide layer on the PCB, the first coupling layer connecting the bottom waveguide layer to the first waveguide layer.

13. The method according to claim 11, wherein the method further comprises positioning the first coupling layer on the PCB.

14. The method according to claim 11, wherein the method further comprises arranging an antenna element for each resulting waveguide conducting tube at the waveguide layer that is furthest from the PCB, each antenna element having an antenna aperture that is used for interfacing with a transmission medium for transmission and reception of RF, radio frequency, waveforms.

15. The method according to claim 11, wherein the method further comprises arranging filtering elements in each resulting waveguide conducting tube, such that a radio frequency signal passing via a resulting waveguide conducting tube is arranged to be electromagnetically filtered.

* * * * *